US008695258B2

(12) United States Patent
Kori et al.

(10) Patent No.: US 8,695,258 B2
(45) Date of Patent: Apr. 15, 2014

(54) NAMEPLATE ATTACHMENT STRUCTURE, CAMERA PLATFORM APPARATUS, AND CAMERA APPARATUS

(75) Inventors: Yoshifumi Kori, Tokyo (JP); Akira Yokoyama, Utsunomiya (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/479,447

(22) Filed: May 24, 2012

(65) Prior Publication Data

US 2012/0304517 A1 Dec. 6, 2012

(30) Foreign Application Priority Data

Jun. 1, 2011 (JP) ..... 2011-123463

(51) Int. Cl.
*G09F 7/00* (2006.01)

(52) U.S. Cl.
USPC ..... 40/663; 403/348; 411/552; D16/242

(58) Field of Classification Search
USPC ..... 248/686, 220.41, 223.31, 345.1; 403/326; 411/508, 913; 396/353; 40/620, 622, 661.04; D16/242
See application file for complete search history.

(56) References Cited

U.S. PATENT DOCUMENTS

| | | | | | |
|---|---|---|---|---|---|
| 2,260,048 | A | * | 10/1941 | Newell | 411/552 |
| 2,355,196 | A | * | 8/1944 | Zahodiakin | 411/349 |
| 3,009,381 | A | * | 11/1961 | Rapata | 411/337 |
| 4,216,697 | A | * | 8/1980 | Wilson | 411/15 |
| 4,657,462 | A | * | 4/1987 | Hoen | 411/552 |
| 5,368,427 | A | * | 11/1994 | Pfaffinger | 411/553 |
| D366,887 | S | * | 2/1996 | Wood | D16/242 |
| 5,526,598 | A | * | 6/1996 | Watanabe | 40/308 |
| 5,599,512 | A | * | 2/1997 | Latulippe et al. | 422/300 |
| 5,613,874 | A | * | 3/1997 | Orlando et al. | 439/491 |
| 5,632,586 | A | * | 5/1997 | Nyholm | 411/552 |
| D389,166 | S | * | 1/1998 | Swayze et al. | D16/242 |
| 5,797,714 | A | * | 8/1998 | Oddenino | 411/508 |
| D405,815 | S | * | 2/1999 | Takizawa | D16/242 |
| D434,431 | S | * | 11/2000 | Whitby et al. | D16/242 |
| D446,234 | S | * | 8/2001 | Shih | D16/202 |
| 6,305,892 | B1 | * | 10/2001 | Qiao | 411/508 |
| D468,336 | S | * | 1/2003 | Kampf et al. | D16/242 |
| D471,578 | S | * | 3/2003 | Okuley | D16/242 |
| D478,108 | S | * | 8/2003 | Miyazaki | D16/202 |
| D483,052 | S | * | 12/2003 | Utsunomiya | D16/242 |

(Continued)

FOREIGN PATENT DOCUMENTS

| | | |
|---|---|---|
| JP | 2005-084221 A | 3/2005 |
| JP | 2007-162794 A | 6/2007 |

*Primary Examiner* — Shin Kim
(74) *Attorney, Agent, or Firm* — Rossi, Kimms & McDowell LLP

(57) ABSTRACT

A nameplate attachment structure enables a nameplate to be attached in at least two variations of postures to a chassis outer surface of an apparatus, the nameplate being formed of an elastic body, the nameplate including: a shaft projected on a rear surface of an indication surface and having a distal end including a locking stop; and at least two engagement pieces respectively having hook projections, the chassis outer surface including: a support hole through which the shaft is inserted; and at least two engagement holes engageable with the engagement pieces. When the shaft is inserted through the support hole, the locking stop restricts movement of the nameplate in a direction in which the shaft extends, and when the engagement pieces are inserted through the engagement holes, the hook projections are engaged with the engagement holes so that the nameplate is attached to the chassis outer surface.

15 Claims, 7 Drawing Sheets

(56) References Cited

U.S. PATENT DOCUMENTS

| | | | | | |
|---|---|---|---|---|---|
| D485,234 | S | * | 1/2004 | Katayama | D13/108 |
| 6,679,646 | B2 | * | 1/2004 | Quardt et al. | 403/348 |
| D500,511 | S | * | 1/2005 | Sybilrud | D16/203 |
| 6,916,145 | B2 | * | 7/2005 | Lydan | 411/510 |
| D529,533 | S | * | 10/2006 | Oh et al. | D16/242 |
| 7,147,399 | B2 | * | 12/2006 | Viscount et al. | 403/349 |
| D536,360 | S | * | 2/2007 | Dayan | D16/242 |
| D539,327 | S | * | 3/2007 | Andre et al. | D16/242 |
| D542,319 | S | * | 5/2007 | Ishida et al. | D16/203 |
| D552,144 | S | * | 10/2007 | Logan et al. | D16/202 |
| D553,662 | S | * | 10/2007 | Grotto | D16/242 |
| D556,803 | S | * | 12/2007 | Ishida | D16/203 |
| D557,320 | S | * | 12/2007 | Fisher et al. | D16/242 |
| D610,601 | S | * | 2/2010 | Melder | D16/242 |
| 7,661,215 | B2 | * | 2/2010 | Okamoto | 40/620 |
| 7,690,141 | B2 | * | 4/2010 | Steinfort et al. | 40/301 |
| D624,109 | S | * | 9/2010 | Wang et al. | D16/242 |
| D632,719 | S | * | 2/2011 | Tsai | D16/202 |
| D649,175 | S | * | 11/2011 | Willis | D16/242 |
| D661,718 | S | * | 6/2012 | Tang | D16/202 |
| 2004/0190987 | A1 | * | 9/2004 | Yang | 403/348 |
| 2007/0131838 | A1 | * | 6/2007 | Okamoto | 248/560 |

* cited by examiner

NAMEPLATE ATTACHMENT STRUCTURE, CAMERA PLATFORM APPARATUS, AND CAMERA APPARATUS

BACKGROUND OF THE INVENTION

1. Field of the Invention

The present invention relates to a nameplate attachment structure, and more particularly, to a nameplate attachment structure for an apparatus such as a camera platform apparatus to be set in two or more variations of postures, and to a camera platform apparatus and a camera apparatus.

2. Description of the Related Art

Conventionally, there has been known a camera platform apparatus having a chassis outer surface on which a manufacturer's logo is indicated. Such a camera platform apparatus is set in an upright posture, and may also be set in a ceiling-suspended posture. Thus, in accordance therewith, it is desired that indication be recognized in orientations corresponding to such installation postures.

For example, Japanese Patent Application Laid-Open No. 2007-162794 discloses the following structure. That is, a shaft including a hook portion is projected on a rear surface of a nameplate, and the shaft is inserted through a hole provided in a plate-like part. Further, a spring member is attached to the hook portion of the shaft so that the nameplate is urged in an axial direction and is attached to be adjustable in a turnable manner with respect to the hole of the plate-like part.

Further, Japanese Patent Application Laid-Open No. 2005-084221 discloses a structure in which a recessed portion is provided in an attachment surface for a nameplate so that, when the nameplate is pushed to be detached, the nameplate is sunk into the recessed portion and an opposite surface with respect to a shaft-like portion of the nameplate is raised. In this way, the nameplate can be detached and attached in different postures of indication.

However, in the conventional technology disclosed in Japanese Patent Application Laid-Open No. 2007-162794, it is necessary to provide a spring member so that the nameplate is attached to be adjustable in a turnable manner. Thus, a larger number of components are required. Further, in the conventional technology disclosed in Japanese Patent Application Laid-Open No. 2005-084221, it is necessary to change the shape of the nameplate itself for each product because the attachment surface for the nameplate varies from product to product. In addition, the conventional technology disclosed in Japanese Patent Application Laid-Open No. 2005-084221 is only capable of supporting postures at every 180 degrees.

SUMMARY OF THE INVENTION

The present invention provides a nameplate attachment structure for enabling nameplates to be attached with a simple configuration in accordance with installation postures of apparatus varying from each other in surface shape.

According to an exemplary embodiment of the present invention, there is provided a nameplate attachment structure, which enables a nameplate to be attached in at least two variations of postures to a chassis outer surface of an apparatus, the nameplate being formed of an elastic body, the nameplate including: a shaft projected on a rear surface of an indication surface and having a distal end including a locking stop; and at least two engagement pieces respectively having hook projections, the chassis outer surface including: a support hole through which the shaft is inserted; and at least two engagement holes engageable with the at least two engagement pieces, in which, when the shaft is inserted through the support hole, the locking stop restricts movement of the nameplate in a direction in which the shaft extends, and in which, when the at least two engagement pieces are inserted through the at least two engagement holes, the hook projections are engaged with the at least two engagement holes so that the nameplate is attached to the chassis outer surface.

According to the present invention, the nameplates can be attached with a simple configuration in accordance with installation postures of apparatus varying from each other in surface shape.

Further features of the present invention will become apparent from the following description of exemplary embodiments with reference to the attached drawings.

DESCRIPTION OF THE EMBODIMENTS

In the following, exemplary embodiments of the present invention are described in detail with reference to the accompanying drawings.

(First Embodiment)

Figure 1:
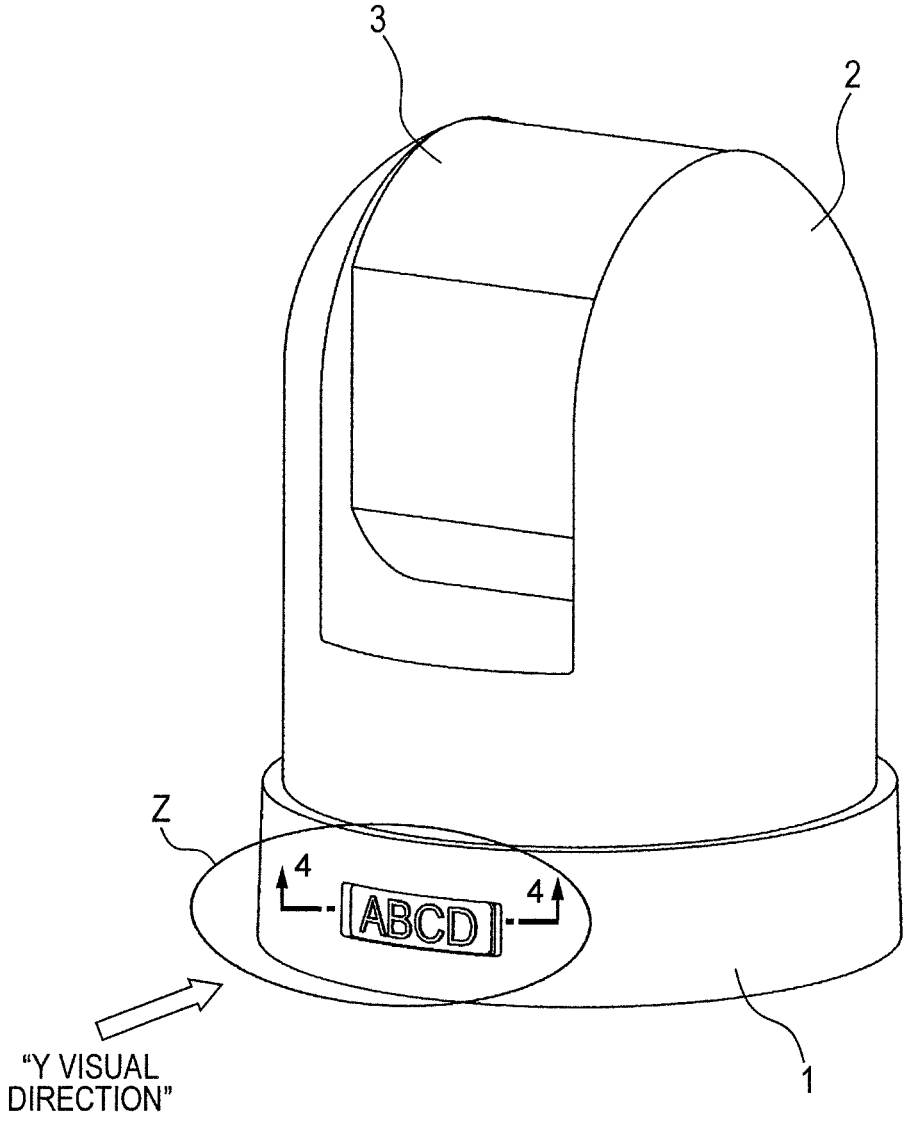
FIG. 1 is a perspective view of a camera platform apparatus provided with a nameplate attachment structure according to a first embodiment of the present invention.

In the following, with reference to FIGS. 1 to 9, a nameplate attachment structure according to a first embodiment of the present invention is described. FIG. 1 is a perspective view of a camera platform apparatus provided with the nameplate attachment structure according to the first embodiment of the present invention. A head 2 is attached to a base 1 supported by a tripod (not shown) or the like so as to be pivotable in a horizontal direction, and a housing 3 having an image pickup apparatus mounted thereto is attached to the head 2 so as to be pivotable in a perpendicular direction. The base 1 is provided with a directional indication unit Z indicating information, a picture, a shape, and the like. The base 1, the head 2, the housing 3, and the image pickup apparatus mounted to the housing 3 form a camera apparatus.

Figure 2:
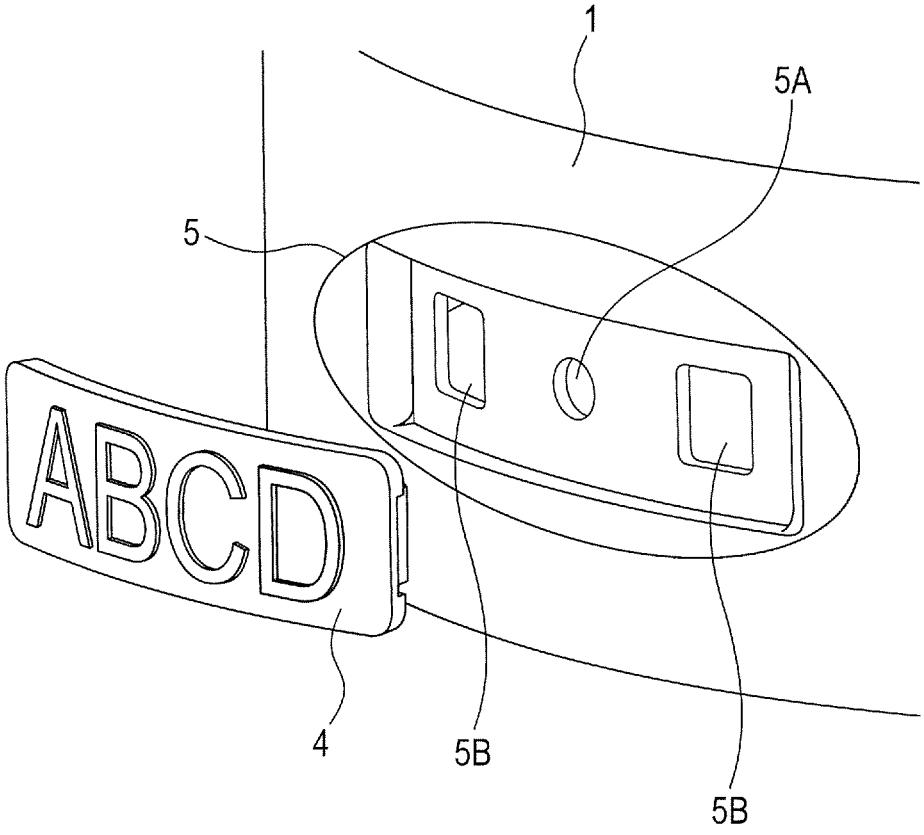
FIG. 2 is an exploded perspective view of an indication unit Z, which is viewed from a Y visual direction of FIG. 1.
Figure 3:
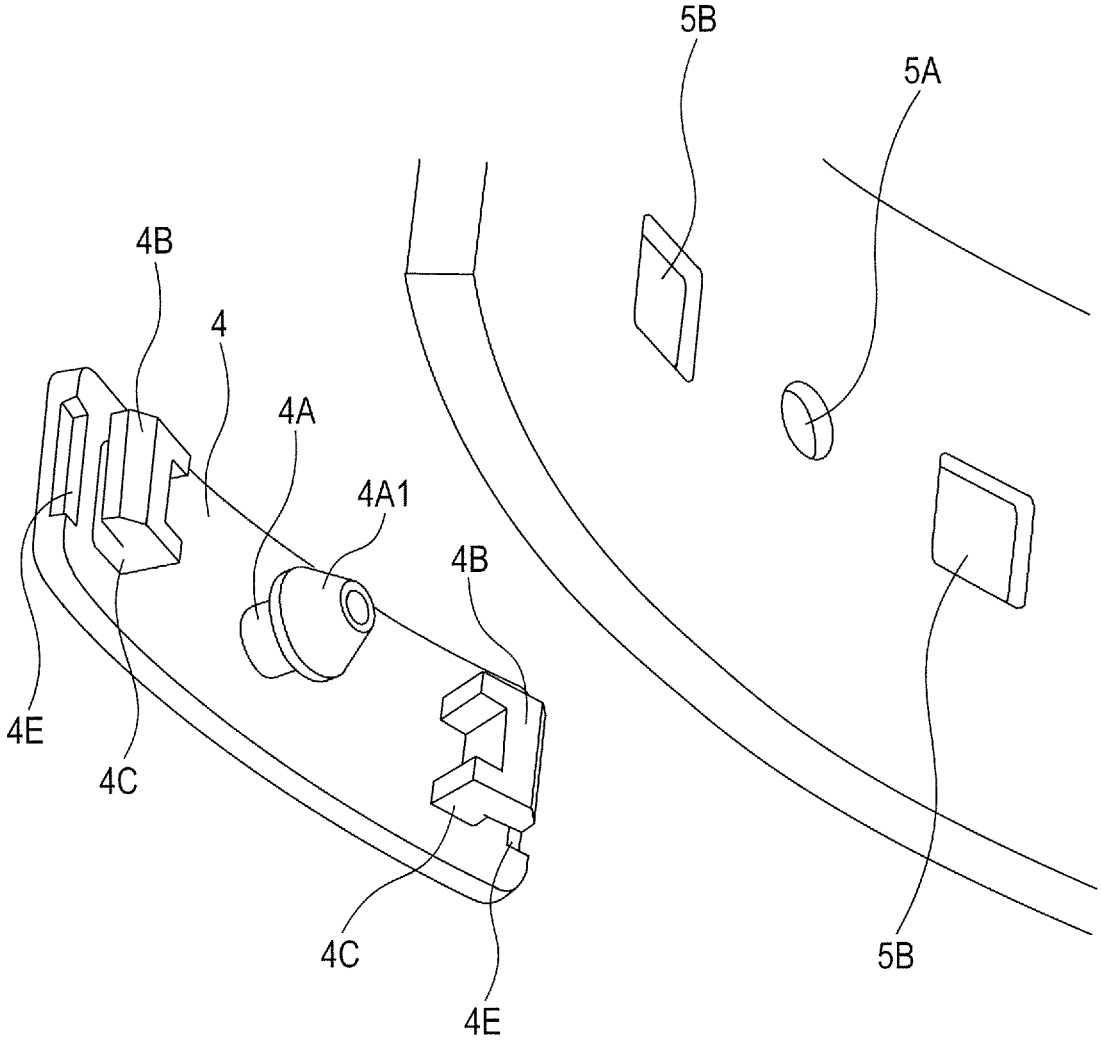
FIG. 3 is another exploded perspective view of the indication unit Z, for illustrating a structure of FIG. 2 in a view from an inside of the camera platform apparatus.
Figure 4:
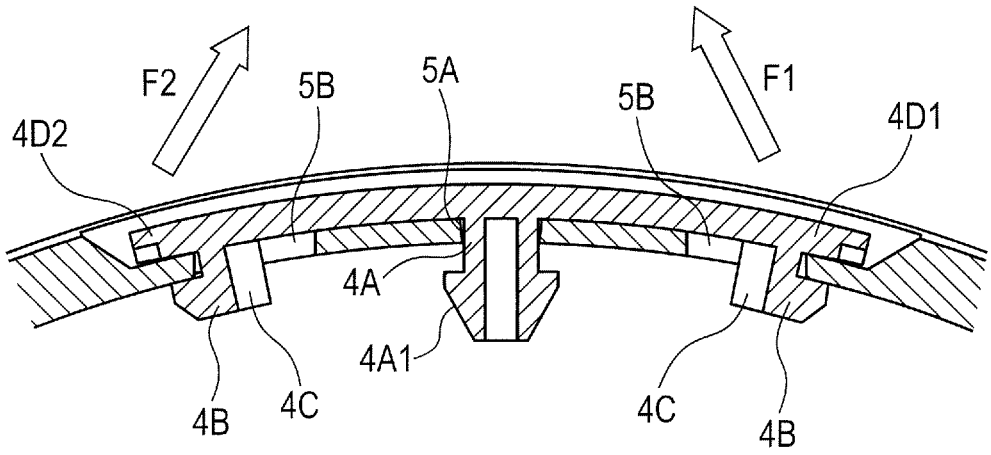
FIG. 4 is a sectional view taken along the line 4-4 of FIG. 1, for illustrating a state in which a nameplate 4 is attached to a containing unit 5.

FIG. 2 is an exploded perspective view of the indication unit Z, which is viewed from a Y visual direction of FIG. 1. FIG. 3 is another exploded perspective view of the indication unit Z, for illustrating a structure of FIG. 2 in a view from an inside of the base 1. FIG. 4 is a sectional view taken along the line 4-4 of FIG. 1. A nameplate 4 and a containing unit 5 containing the nameplate 4 in a turnable manner form the indication unit Z. As illustrated in FIG. 3, the nameplate 4 is provided with a shaft 4A formed so as to be projected substantially at a center of a rear surface of an indication surface on which indication is present and to have a distal end including a hook locking stop 4A1. The nameplate 4 also includes engagement pieces 4C respectively provided with hook projections 4B formed at two points symmetrically across the shaft 4A, and is formed of an elastic body such as rubber, silicone rubber, and plastic (hereinafter, referred to as "rubber or the like"). The containing unit 5 is provided with a support hole 5A through which the shaft 4A is inserted and supported to be turnable, and engagement holes 5B formed at two points through which the engagement pieces 4C are inserted. With reference to FIG. 4, a state in which the nameplate 4 is attached to the containing unit 5 is described. When the shaft 4A of the nameplate 4 is inserted through the support hole 5A, the locking stop 4A1 restricts movement of the nameplate 4 in a direction in which the shaft 4A of the nameplate 4 extends (axial direction). Then, when the engagement pieces 4C are inserted through the engagement holes 5B, by an elastic force of the nameplate 4, the hook projections 4B are engaged with the engagement holes 5B under a state in which the hook projections 4B are urged to edge portions of the engagement holes 5B. In this way, in conformity with a surface shape of the base 1, the nameplate 4 is attached to the containing unit 5.

Figure 5:
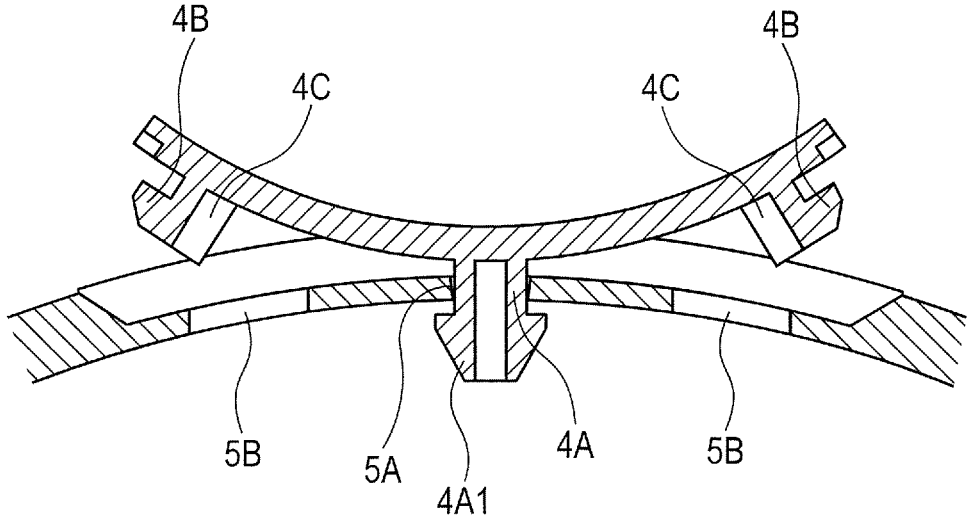
FIG. 5 illustrates a state in which engagement pieces 4C of the nameplate 4 are pulled out from engagement holes 5B in relation to FIG. 4.
Figure 6:
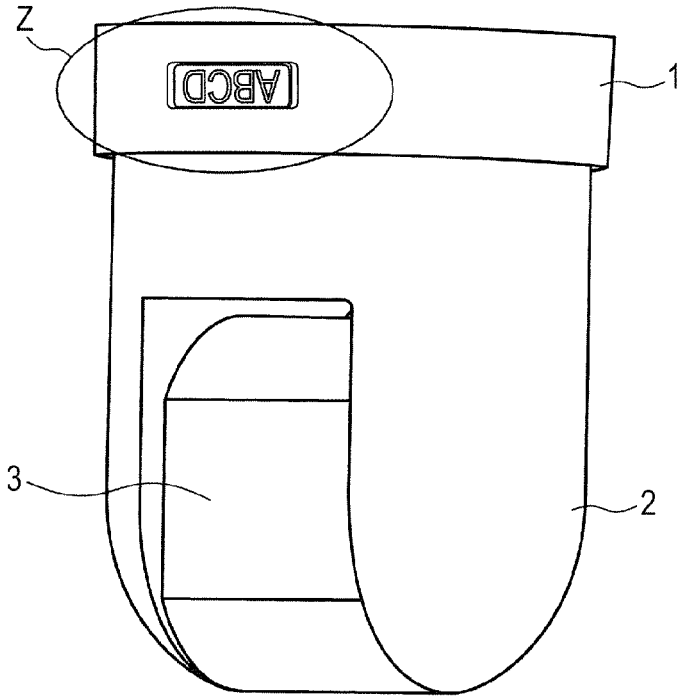
FIG. 6 is a perspective view for illustrating a ceiling-suspended state of the camera platform apparatus provided with the nameplate attachment structure according to the first embodiment of the present invention.
Figure 7:
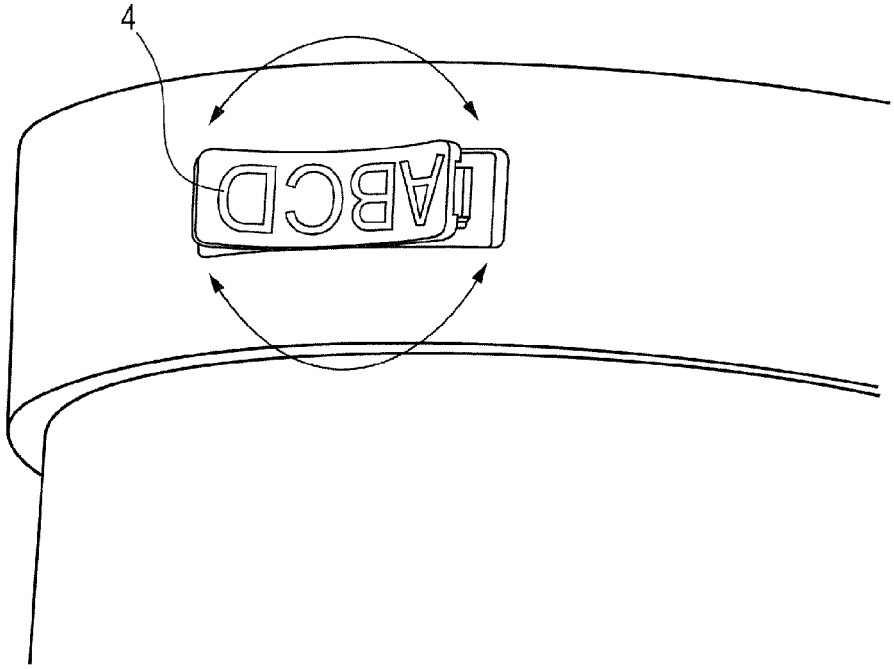
FIG. 7 is a perspective view for illustrating a state in which the engagement pieces 4C of the nameplate 4 are pulled out from the engagement holes 5B so that the nameplate 4 is turnable.

With reference to FIGS. 4 to 7, how to change a posture of the nameplate 4 is described. FIG. 6 illustrates the camera platform apparatus set in a ceiling-suspended state. In this state, the indication unit Z is upside down together with the camera platform apparatus, and hence is directed so that the indication is hard to recognize. As illustrated in FIG. 4, a force F1 and a force F2 are applied respectively to an end portion 4D1 and an end portion 4D2 of the nameplate 4 so that the nameplate 4 is elastically deformed. With this, the hook projections 4B are disengaged, and the engagement pieces 4C are pulled out from the engagement holes 5B. FIG. 5 illustrates a state in which the engagement pieces 4C are pulled out from the engagement holes 5B. In this state, the nameplate 4 is turnable about the shaft 4A as illustrated in FIG. 7, and hence can be turned in a direction in which indication is easily recognized, and then re-attached to the containing unit 5. With the operation performed as described above, the nameplate 4 can be attached in various postures in accordance with an installation posture of the camera platform apparatus.

In this way, in this embodiment, the directional nameplate 4 indicating information, a picture, a shape, and the like is formed of an elastic body such as elastically deformable rubber. Further, the nameplate 4 is provided with the engagement pieces 4C having the hook projections 4B formed thereon so that the nameplate 4 can be supported to be turnable about the shaft 4A in the containing unit 5 and attached in conformity with the surface shape of the base 1 provided with the indication unit Z.

According to this embodiment, the nameplate 4 is formed of an elastic body such as rubber, and the engagement pieces 4C are detachable and insertable with respect to the engagement holes 5B. Thus, there is an advantage that, even when the nameplate 4 is once attached in a predetermined indication direction to the base 1, the posture of the nameplate 4 can be changed thereafter in accordance with an installation posture of the camera platform apparatus. Further, the nameplate 4 is elastically deformed, and hence can be conformed to various surface shapes. With this, the single nameplate 4 can support apparatus of various surface shapes, and hence parts of the same type can be used as the nameplate.

Further, as illustrated in FIG. 3, in the rear surface of the indication surface of the nameplate 4, cutouts 4E may be provided at the end portions on sides on which the engagement pieces 4C are provided. With provision of the cutouts 4E, the forces F1 and F2 are easily applied respectively to the end portions 4D1 and 4D2. As a result, in addition to the above-mentioned advantage, the nameplate 4 can be more rapidly and easily detached and inserted with respect to the containing unit 5.

Figure 8:
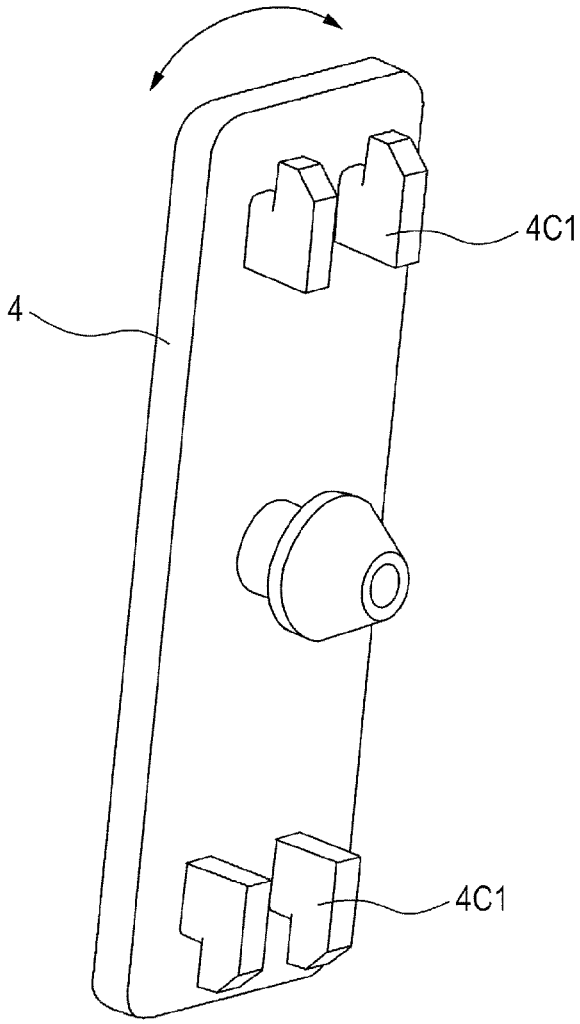
FIG. 8 illustrates the nameplate 4 provided with other engagement pieces 4C1 each having a shape different from those of the engagement pieces 4C.
Figure 9:
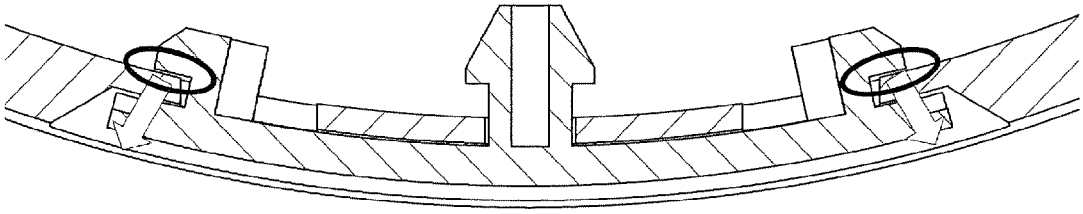
FIG. 9 is a schematic view for illustrating how an urging force is applied from hook projections 4B of the engagement pieces 4C of the nameplate 4 to the engagement holes 5B.

Further, as engagement pieces 4C1 illustrated in FIG. 8, each of the engagement pieces 4C of the nameplate 4 may be formed to have a cutout central portion. In other words, each of the engagement pieces 4C, which are provided on both end sides of the nameplate 4 in a longitudinal direction thereof, may be replaced with the engagement pieces 4C1 formed of multiple engagement pieces divided in a lateral direction orthogonal to the longitudinal direction (without a component extending in the lateral direction). With the engagement pieces 4C1 configured as described above and provided on both the end sides of the nameplate 4 in the longitudinal direction, the nameplate 4 can be attached also in conformity with a lateral curved surface of a nameplate attachment portion of a chassis of the camera platform apparatus and the like without a necessity of increasing a rigidity against curving to impart a curvature in the lateral direction perpendicular to the longitudinal direction (that is, a direction of the arrows indicated in FIG. 8).

Note that, it is preferred to set the nameplate so that one of the following conditions is satisfied.

$$R1 \times R2 > 0 \text{ and } R1 > R2 \quad (1)$$

$$R1 < 0 \text{ and } R2 > 0 \quad (2)$$

an attachment surface for the nameplate is flat and $$R1 < 0 \quad (3)$$

where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side (side opposite to the attachment side), and a sign of the R2 is plus when the attachment surface for the nameplate of the chassis outer surface is convex to the nameplate side.

When the curvature radius R1 of the surface of the nameplate 4 on the chassis outer surface side and the curvature radius R2 of the attachment surface for the nameplate 4 of the chassis outer surface are set to satisfy those conditions, an elastic restoring force of a material of the nameplate is generated. As a result, when the nameplate 4 is attached to the attachment surface, the hook projections 4B of the engagement pieces 4C, which are configured to be directed to the opposite side (opposite direction) with respect to the shaft 4A, are engaged with the engagement holes 5B by urging forces acting on the opposite side (opposite direction) with respect to the shaft 4A (forces indicated by the arrows at parts represented by ellipses in FIG. 9). Thus, the nameplate 4 can be stably attached to the attachment portion without play.

Further, in the example of this embodiment, the hook projections 4B of the engagement pieces 4C of the nameplate 4 are configured to be directed to the opposite side with respect to the shaft 4A, but the present invention is not limited thereto. For example, the hook projections 4B of the engagement pieces 4C of the nameplate 4 may be directed to the shaft 4A side. In this case, it is preferred to set the nameplate so that one of the following conditions is satisfied.

$$R1 \times R2 > 0 \text{ and } R1 < R2 \quad (4)$$

$$R1 > 0 \text{ and } R2 < 0 \quad (5)$$

the attachment surface for the nameplate is flat and $$R1 > 0 \quad (6)$$

When the curvature radius R1 of the surface of the nameplate 4 on the chassis outer surface side and the curvature radius R2 of the attachment surface for the nameplate 4 of the chassis outer surface are set to satisfy those conditions, the elastic restoring force of the material of the nameplate is generated. As a result, when the nameplate 4 is attached to the attachment surface, the hook projections 4B of the engagement pieces 4C, which are configured to be directed to the shaft 4A side (direction of the shaft 4A), are engaged with the engagement holes 5B by urging forces acting on the shaft 4A side (direction of the shaft 4A). Thus, the nameplate 4 can be stably attached to the attachment portion without play. This setting is suitable to a case where there is no dimensional margin on the longitudinal outer side of the attachment surface for the nameplate 4 and it is difficult to form, on a longitudinal outer side of each of the engagement holes 5B, engagement portions with which the hook projections 4B are engaged. With this, the nameplate 4 can be fixed in a manner that the attachment surface for the nameplate 4 is caught from outside between the hook projections 4B of the nameplate 4.

(Second Embodiment)

In the following, with reference to FIGS. 10 and 11, a nameplate attachment structure according to a second embodiment of the present invention is described. This embodiment is a modified example of the first embodiment and the same positions and components as those of the second embodiment are represented by the same reference symbols, and detailed description thereof is therefore omitted herein.

Figure 10:
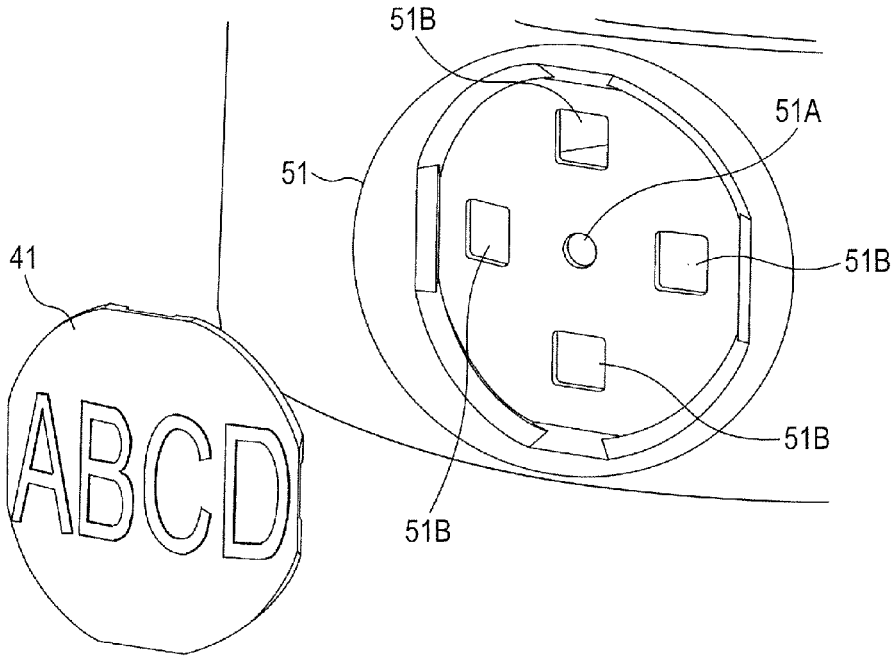
FIG. 10 is an exploded perspective view of a nameplate 41 and a containing unit 51 of a nameplate attachment structure according to a second embodiment of the present invention.
Figure 11:
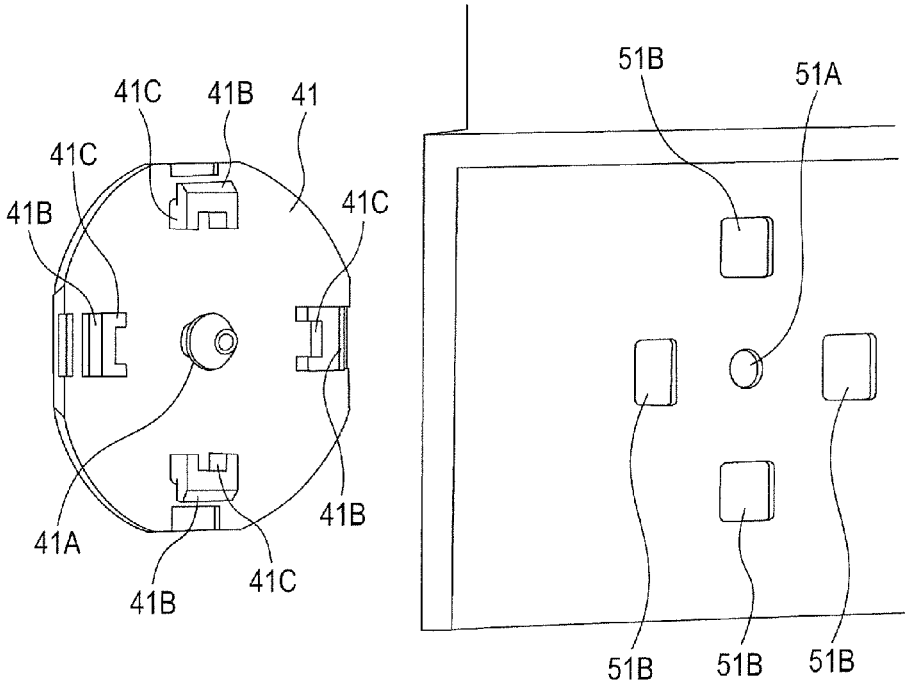
FIG. 11 illustrates a structure of FIG. 10 in a view from an inside of the camera platform apparatus.

FIG. 10 is a perspective view of a nameplate 41 and a containing unit 51 viewed from the same direction as that in FIG. 2 of the first embodiment. FIG. 11 illustrates a structure of FIG. 10 in a view from the inside of the base 1. As illustrated in FIG. 11, on a rear side of an indication-present surface of the nameplate 41, engagement pieces 41C respectively provided with hook projections 41B are formed at four positions. The four positions are provided at equal intervals about a shaft 41A, specifically, an angular relationship of 90 degrees is maintained with respect to each other. Further, correspondingly to the engagement pieces 41C, engagement holes 51B are formed at four positions in the containing unit 51, and similarly, an angular relationship of 90 degrees is maintained with respect to each other about a support hole 51A.

Next, how to change a posture of the nameplate 41 is described. As in the first embodiment, all of four end portions of the engagement pieces 41C of the nameplate 41 are elastically deformed. With this, the hook projections 41B are disengaged, and the engagement pieces 41C are pulled out from the engagement holes 51B. At this time, the nameplate 41 is turnable about the shaft 41A. In this way, the posture of the nameplate 41 can be changed in accordance with the posture of the camera platform apparatus.

In other words, according to this embodiment, the engagement pieces 41C are arranged at every 90 degrees about the shaft 41A. Thus, there is an advantage that the posture of the nameplate 41 can be changed at every 90 degrees.

(Other Embodiments)

The shaft 4A of the nameplate 4 of the first embodiment of the present invention and the shaft 41A of the nameplate 41 of the second embodiment may be made of a resin material. With use of the resin material, a frictional force between the shaft 4A and the support hole 5A of the containing unit 5 and between the shaft 41A and the support hole 51A of the containing unit 51 is reduced, and hence the shaft 4A can be more easily inserted through the support hole 5A and the shaft 41A can be more easily inserted through the support hole 51A. Further, the nameplate 4 can be more easily turned about the support hole 5A and the nameplate 41 can be more easily turned about the support hole 51A. In the second embodiment, angular adjustment is performed at every 90 degrees, but the angular adjustment is not limited to every 90 degrees. For example, through increase of the number of the engagement holes 51B, adjustment may be performed at every 15 degrees or every 30 degrees.

Further, in the second embodiment, the engagement pieces 41C are provided at four positions so as to be rotationally symmetrical with each other with respect to the shaft 41A. However, a similar advantage of the present invention can be obtained as long as multiple engagement pieces are provided in a rotationally symmetrical relationship with respect to the shaft. Further, with this, various nameplates can be appropriately attached irrespective of shapes of the nameplates themselves and shapes of chassis outer surfaces of apparatus to which the nameplates are attached.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-123463, filed Jun. 1, 2011, which is hereby incorporated by reference herein in its entirety.

What is claimed is:

1. A nameplate attachment structure comprising:

a chassis of an apparatus; and a nameplate formed of an elastic body attachable in at least two variations of postures to an outer surface of the chassis, wherein the nameplate comprises:

a shaft projected on a rear surface of an indication surface and having a distal end including a locking stop;

at least two engagement pieces respectively having hook projections; and at least two cutouts provided at end portions thereof in the rear surface of the indication surface of the nameplate on sides on which the at least two engagement pieces are provided, wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, and wherein when the at least two engagement pieces are inserted through the at least two engagement holes, the hook projections are engaged with the at least two engagement holes so that the nameplate is attached to the chassis outer surface.

2. A nameplate attachment structure comprising:

a chassis of an apparatus; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections;

wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only to an opposite side with respect to the shaft including the locking stop, and wherein one of the following conditions is satisfied:

$R1 \times R2 > 0$ and $R1 > R2$;

$R1 < 0$ and $R2 > 0$; or an attachment surface for the nameplate is flat and R1<0, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

3. A nameplate attachment structure comprising:

a chassis of an apparatus; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections;

wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only toward the shaft including the locking stop, and wherein one of the following conditions is satisfied:

$R1 \times R2 > 0$ and $R1 < R2$;

R1>0 and R2<0; or an attachment surface for the nameplate is flat and R1>0, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

4. The nameplate attachment structure according to claim 2, wherein the elastic body forming the nameplate comprises one of rubber, silicone rubber, or plastic.

5. The nameplate attachment structure according to claim 2, wherein each of the at least two engagement pieces is divided in a direction orthogonal to a longitudinal direction of the nameplate.

6. The nameplate attachment structure according to claim 2, wherein the shaft is made of a resin material.

7. The nameplate attachment structure according to claim 2, wherein the nameplate comprises at least two cutouts provided at end portions thereof in the rear surface of the indication surface of the nameplate on sides on which the at least two engagement pieces are provided.

8. The nameplate attachment structure according to claim 3, wherein the elastic body forming the nameplate comprises one of rubber, silicone rubber, or plastic.

9. The nameplate attachment structure according to claim 3, wherein each of the at least two engagement pieces is divided in a direction orthogonal to a longitudinal direction of the nameplate.

10. The nameplate attachment structure according to claim 3, wherein the shaft is made of a resin material.

11. The nameplate attachment structure according to claim 3, wherein the nameplate comprises at least two cutouts provided at end portions thereof in the rear surface of the indication surface of the nameplate on sides on which the at least two engagement pieces are provided.

12. A camera platform apparatus comprising:

an apparatus having a chassis; and a nameplate attachment structure comprising:

the chassis; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections, wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, and wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only to an opposite side with respect to the shaft including the locking stop, and wherein one of the following conditions is satisfied:

$R1 \times R2 > 0$ and $R1 > R2$;

$R1 < 0$ and $R2 > 0$; or an attachment surface for the nameplate is flat and $R1 < 0$, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

13. A camera apparatus comprising:

an apparatus having a chassis; and a nameplate attachment structure comprising:

the chassis; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections, wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only to an opposite side with respect to the shaft including the locking stop, and wherein one of the following conditions is satisfied:

$R1 \times R2 > 0$ and $R1 > R2$;

$R1 < 0$ and $R2 > 0$; or an attachment surface for the nameplate is flat and $R1 < 0$, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

14. A camera platform apparatus comprising:

an apparatus having a chassis; and a nameplate attachment structure comprising:

the chassis; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections, wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only toward the shaft including the locking stop, and wherein one of the following conditions is satisfied:

$R1 \times R2 > 0$ and $R1 < R2$;

$R1 > 0$ and $R2 < 0$; or an attachment surface for the nameplate is flat and $R1 > 0$, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

15. A camera apparatus comprising:

an apparatus having a chassis; and a nameplate attachment structure comprising:

the chassis; and a nameplate formed of an elastic body attachable in at least two variations of postures to an outer surface of the chassis, wherein the nameplate comprises:

a shaft projected on a rear surface of an indication surface and having a distal end including a locking stop; and at least two engagement pieces respectively having hook projections, wherein the chassis outer surface comprises:

a support hole through which the shaft is inserted; and at least two engagement holes engageable with the at least two engagement pieces, wherein when the shaft is inserted through the support hole, the locking stop restricts movement of the nameplate in a direction in which the shaft extends, and wherein when the at least two engagement pieces are inserted through the at least two engagement holes, the hook projections are engaged with the at least two engagement holes so that the nameplate is attached to the chassis outer surface, wherein the at least two engagement pieces are formed at positions rotationally symmetrical with each other with respect to the shaft, wherein each of the hook projections of the at least two engagement pieces is directed only toward the shaft including the locking stop, and wherein one of the following conditions is satisfied:

$R1 \times R2 > 0$ and $R1 < R2$;

$R1 > 0$ and $R2 < 0$; or an attachment surface for the nameplate is flat and $R1 > 0$, where R1 represents a curvature radius of a surface of the nameplate on the chassis outer surface side, and R2 represents a curvature radius of the attachment surface for the nameplate of the chassis outer surface, provided that a sign of the R1 is plus when the surface of the nameplate on the chassis outer surface side is convex to the nameplate side, and a sign of the R2 is plus when the attachment surface for the nameplate of the chassis outer surface is convex to the nameplate side.

* * * * *